United States Patent [19]

Hutson

[11] Patent Number: 4,484,459

[45] Date of Patent: Nov. 27, 1984

[54] BIASED MULTI-LAYER STRUCTURAL FABRIC COMPOSITES STITCHED IN A VERTICAL DIRECTION AND PROCESS AND APPARATUS FOR MAKING SAME

[75] Inventor: Harold K. Hutson, Seguin, Tex.

[73] Assignee: Knytex Proform, Seguin, Tex.

[21] Appl. No.: 536,734

[22] Filed: Sep. 28, 1983

[51] Int. Cl.[3] ..... D04B 23/06

[52] U.S. Cl. ..... 66/84 A; 28/100; 156/439

[58] Field of Search ..... 66/84 A, 85 A; 28/100; 156/439, 440

[56] References Cited

U.S. PATENT DOCUMENTS

| | | | |
|---|---|---|---|
| 3,321,348 | 5/1967 | Rupp | 66/84 A X |
| 3,573,151 | 3/1971 | Dawbarn | 156/439 X |
| 3,607,565 | 9/1971 | Eaton | 28/100 |
| 3,680,332 | 8/1972 | Bassist | 66/84 A |
| 3,756,893 | 9/1973 | Smith | 156/440 |
| 3,878,591 | 4/1975 | Jense | 28/100 |
| 4,380,913 | 4/1983 | Wilkens | 66/84 A |
| 4,395,888 | 8/1983 | Wilkens | 66/84 A |

FOREIGN PATENT DOCUMENTS

| | | | |
|---|---|---|---|
| 3040393 | 4/1982 | Fed. Rep. of Germany | 66/84 A |
| 316742 | 11/1969 | Sweden | 28/100 |
| 1299638 | 12/1972 | United Kingdom | 66/84 A |

*Primary Examiner*—Ronald Feldbaum
*Attorney, Agent, or Firm*—Oblon, Fisher, Spivak, McClelland & Maier

[57] ABSTRACT

Non-woven, multi-layer biased structural fabric is disclosed, which is comprised of at least three layers of parallel structural fibers, with no secondary yarns or fibers in the plane of the layers to hold said fibers in parallel relationship. Both the vertical relationship of the layers and the parallelity of the fibers within each layer is maintained by vertical stitching. The fabric may be made into a structural composite by saturation and subsequent curing with a curable, crosslinking resin. An apparatus and method for forming that fabric and composite is also disclosed, which is comprised of aligned weft lay down carriages arranged sequentially and further aligned with a stitching machine. A means for advancing the fibers from each weft lay down carriage into the stitching machine passes along the weft carriages. As each layer is laid down on top of the previous layer, it is engaged by the advancing means and so brought into the stitching machine, where the layers are vertically stitched through. At least one of the weft carriages is oriented with respect to the stitching machine, so that the fibers laid down thereby comprise a biased layer.

5 Claims, 6 Drawing Figures

BIASED MULTI-LAYER STRUCTURAL FABRIC COMPOSITES STITCHED IN A VERTICAL DIRECTION AND PROCESS AND APPARATUS FOR MAKING SAME

BACKGROUND OF THE INVENTION

1. Field of the Invention

This invention relates to a fabric composite of three or more layers of structural fibers, wherein at least one of the layers is biased. The fabric is further characterized in that the layers are comprised of parallel fibers but there are no "holding" or "secondary" stitches in the horizontal direction, the entire composite being maintained by stitching in the vertical direction only. The invention also relates to the process and apparatus for making this fabric composite.

2. Background of the Prior Art

Structural fabrics have a wide variety of industrial applications wherever high strength is required, but weight must be kept to a minimum. In particular, the aerospace, marine and automobile industries frequently employ structural fabric composites comprised of many layers of structural fibers saturated with a cross-linked and hardened resin as high strength materials. Structural fibers are intended to refer generally to fibers referred to as fiberglass, E-glass, S-glass, boron fibers, carbon fibers and related fibers, which can be characterized as having extremely high Young's modulus. However, fibers of lower modulus but high strength application, such as nylon, may be structural. In general, structural fibers should be distinguished from common household and apparel fabric fibers, where strength is not critical. The layers of these composites are usually biased in directions to maximize the strength of the overall products, frequently in the directions of strongest applied tension or strain.

By biased, it is intended to mean that the structural fibers of any particular layer are substantially oriented at an angle of other than 0° or 90° to the major axes as the fabric composite (i.e., longitudinal and lateral centerlines).

It has long been known that woven fibers are generally inappropriate for extremely high strength requirements, as the fibers themselves, and the stress applied, tend to create weak or break points where the fibers overlap in the weaving, destroying the integrity of the product and rendering the fabric relatively useless.

Accordingly, in order to achieve composites of three or more layers, which are not interwoven, it has been necessary to produce individual layers of parallel structural fibers maintained in that parallel array by "holding" or secondary fibers or layers held in place by resin, transport those individual layers to the molding site, and then "lay-up" the layers, manually rotating succeeding layers in the desired direction or bias, and thereafter saturating the produced "lay-up" with the resin and appropriately thereafter molding the layers into a single composite.

The above-described process has a number of obvious drawbacks. One is the necessity to produce individual, or "uni" layers at the textile manufacturing plant, and thereafter go through the ardous hand labor task of correctly orienting each individual layer at the molding site, which may be many miles distant from the original textile plant.

Additionally, it has been discovered that these type of "lay-up" composites or laminates, when subjected to constant high stress, for example, as in an airplane wing surface or edge, have a tendency to develop cracks or gaps between the layers of fabric, where there is only the resin to hold the fabric together. Once a flaw does appear, it quickly spreads between the layers, rapidly producing complete failure of the composite. At the same time, these lay-ups exhibit extremely low resistance to shearing forces, applied across the laminate, as there is nothing but the resin to hold the layers in vertical array. Once again, a small flaw rapidly results in complete failure of the composite.

There are some methods known to produce nonwoven fabrics of more than one layer, wherein at least one of the layers is biased at an angle other than 0 or 90°. One exemplary process is disclosed in Japanese Patent No. 45-33874, Oct. 30, 1970. A similar process is described in U.S. Pat. No. 2,890,579, to Mauersberger. Essentially, these processes consist of directing fibers through a rapidly oscillating weft lay down carriage, which oscillates between two advancing rows of hooks which engage the fibrous strands, and advances the strands, in parallel array into a stitching machine. However, at most, these processes can produce 2-layer fabrics and accordingly do not completely overcome the aforementioned disadvantages. Additionally, these processes are necessarily limited to forming fabrics wherein the orientation of the fibers of one layer is necessarily the opposite of the orientation of the fibers of the opposing layer, due to the oscillation of the lay down carriage.

An alternative method for making multi-layer composites of more than 2 layers, wherein the layers may each by biased individually, is disclosed in U.S. patent application Ser. No. 210,852 filed Nov. 26, 1980. That process consists of directing formed "uni" layers as described above through nip rollers oriented, with respect to a stitching machine, at an angle thereto, so that the fibers "slide" or slip across, resulting in a bias to the fabric equal to the angle of the nip rollers. However, this process has the drawback of including in the final composite the horizontal "holding" or "secondary" yarns which maintain the fibers in parallel array prior to and during biasing. These same secondary fibers add no strength to the final composite, as they exist only within the layers of parallel fibers, and are, in any event, generally not as strong as the structural fibers of the individual layers. At the same time, however, they add substantial weight to the overall laminate, sometimes making up as much to 5 to 7% of the total weight of the fabric. If it were possible to eliminate these horizontal threads, without jeopardizing the parallel array of the structural fibers in each layer, this weight reduction would have substantial impact, particularly on fuel efficiency, in light of the industries in which these composites are employed. Furthermore, this process includes 2 distinct discontinuous steps—1, formation of the uni-layer; 2, vertical stitching.

Accordingly, it is one object of this invention to provide a fabric comprised of three layers of parallel structural fibers, wherein at least one of the layers is biased, the layers being maintained by vertical stitching only, with no horizontal holding threads being present in the composite.

It is another object of this invention to provide a continuous process and apparatus whereby the abovedescribed fabric may be made.

It is yet another object of this invention to provide a fabric, and an apparatus and process for its manufacture, which may suitably be saturated with a resin and yet, upon curing, exhibit substantial resistance to inter-layer crack propagation and shear forces.

These and other objects that will become apparent may be better understood by reference to the detailed description provided below.

SUMMARY OF THE INVENTION

The fabric composite of this invention is comprised of at least three layers of parallel structural fibers, wherein the fibers of at least one layer are oriented at an acute angle to the longitudinal center line of the fabric, i.e., the layer is biased, the fibers being held in parallel array, and the layers being held in vertical array, solely by vertical stitching through the layers. This unitary fabric may be saturated with a resin, which may be subsequently cured, and exhibits substantial crack propagation resistance and interlaminar shear strength. The fabric further comprises such layers stitched to other materials in a stitch-bonded laminate, such as nonwoven mats, paper, etc.

This fabric may be formed using an apparatus which consists of two or more weft lay down carriage mechanisms each aligned with a vertical stitching machine. The lay down carriage mechanisms all lay athwart a means for advancing the fibers delivered therefrom into the stitching machine. At least one of the lay down carriages is oriented at an angle to the fiber advancing means and stitching machine, such that, when fibers are laid down in parallel array by each of the lay down carriages, the fibers from each are deposited on the fibers of the immediately previously laid down carriage mechanism and are advanced into the stitching machine, the fibers from the angled lay down carriages are parallel biased with respect to the major axes of the fabric. In the stitching machine, a vertical stitch is passed between the fibers of each layer through the layers, sufficient to maintain the layers in vertical array and the fibers within each layer in parallel array.

After stitching, the fabric may be stored on a take up roll or cut to a suitable length. When desired, the fabric may be saturated with resin, which is subsequently cured, producing the strong but lightweight composite of the invention.

DETAILED DESCRIPTION OF THE INVENTION

Figure 1:
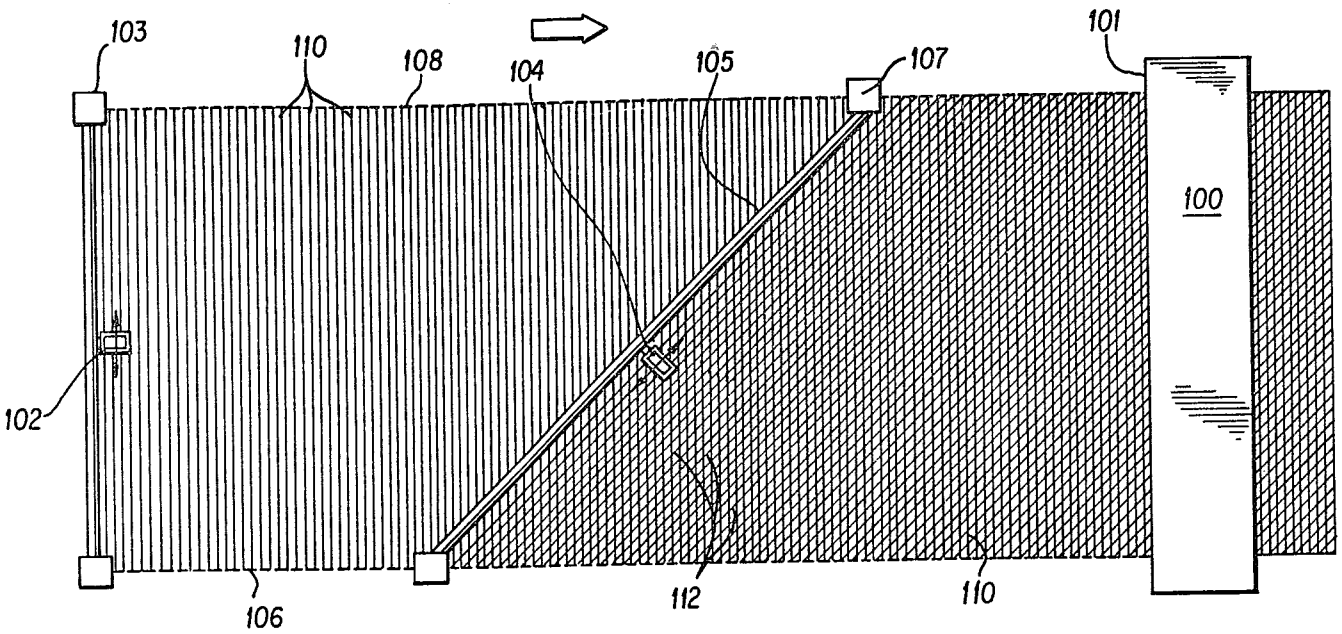
FIGS. 1 and 2 are overhead views of the apparatus of this invention, the arrows indicating the direction of fiber/fabric advancement.

The apparatus, process and composite of this invention resides in the discovery that weft insertion lay-down carriages, or simply "lay down carriages", which are widely used in the art to produce a layer of parallel or crossing over fibers in the weft direction in a fabric which incorporates warp fibers and/or matting which are subsequently stitched together in the stitching machine to which the lay down carriage is attached, may be separated from that machine. Separated, they may be oriented or angled with respect to the face of the stitching machine such that the fibers are laid down in a parallel array, but at an angle equal to the angle of the lay down carriage, such that, when the fibers enter the stitching machine, they are oriented at an angle to the longitudinal center line of the fabric being formed, thus creating a biased layer.

Lay down carriages are widely used and recognized in the art, and no attempt to describe one in detail is made herein. However, a particularly preferred lay down carriage is fully disclosed in U.S. patent application Ser. No. 377,211, filed May 11, 1982, the entire content of which, including the drawings thereof, is incorporated herein by reference. Briefly stated, that lay down carriage is comprised of a frame through which the eventual weft fibers may be led and a "presser bar" apparatus mounted on the frame in a fashion allowing free rotation of the presser bar apparatus. The frame rapidly traverses the width of the stitching machine or weft carriage support, oscillating back and forth between the ends thereof, being driven by a drive train whose speed is synchronized with the speed of the machine. The presser bar apparatus slidably engages a cam mechanism which is mounted on the knitting machine or weft carriage support at a slight angle to the horizontal. The engagement is preferably off-center of the presser bar. As the frame and presser bar apparatus completes a traverse of the width of the knitting machine, the fibers being led through the lay down carriage are depressed by the lower end of the presser bar apparatus being forced downward because of the engagement with the cam.

At the point of maximum depression, the fibers are engaged by a means for advancing the fibers into the knitting machine, generally an endless belt of hooks or needles. The presser bar frame then shuttles to the other side of the knitting machine, where the same operation takes place. By carefully coordinating the speed of the lay down carriage with the knitting machine, and the means for advancing the fibers toward the stitching machine, substantially parallel rows of structural fibers can be laid down at high speed. These fibers are then united with any other layers being inputted to the stitching machine by the vertical stitching effected thereby. However, as noted, this is but one of a number of lay down carriage mechanisms, any of which would be suitable for use in the current invention.

Turning now to the drawings described above, FIG. 1 is an illustration of the apparatus of this invention in its simplest form. A stitching machine 100 is employed, which may be any conventional stitching or knitting machine, and is preferably a compound needle warp knitting machine.

Distant from the knitting machine is a first lay down carriage 102, which is aligned with the knitting machine and is parallel thereto. The fibers supplied by warp lay down carriage 102 will eventually become the bottom-most layer of the fabric to be stitched through in warp knitting machine 100. Situated between stitching machine 100 and lay down carriage 102 is a second lay down carriage 104, together with the associated framework 105. Carriage 104 is "aligned with" knitting machine 100 and first carriage 102, in that the ends 101 of carriage 104 are along the line formed by the ends 101, 103 of stitching machine 100 and lay down carriage 102.

However, carriage 104 is oriented at an acute angle with respect to carriage 102 and stitching machine 100.

Passing along the ends of each of carriages 102 and 104 and into stitching machine 100 is a means for advancing fibers delivered by the lay down carriages into the stitching machine. In a preferred embodiment, as illustrated in FIG. 1, this advancing means is comprised of endless belts of hooks 106 and 108.

Of course, those of ordinary skill will recognize that, in order to maintain the alignment of carriage 104 with carriage 102 and knitting machine 100, but maintain the angled orientation thereof, it will be necessary for carriage 104 to have a traverse longer than that of 102. However, this can conveniently be provided for in interchangeable parts by mounting the framework of each of carriages 102 and 104 on extendable sleeves attached to the vertical posts of the framework. Thereby, the carriage traverses can be shortened or lengthened, as needed. Alternatively, carriages of predetermined length for the various desired angles can be built.

In operation of the apparatus of FIG. 1, weft fibers 110 from carriage 102 are laid down in parallel array and transferred to the advancing rows of hooks 106 and 108. As these fibers are carried toward stitching machine 100, they pass under carriage 104.

Carriage 104 lays down a series of parallel fibers 112 on top of the fibers 110 from carriage 102, however, these fibers 112, due to the orientation of carriage 104, are aligned at an angle or bias to the alignment of fibers 110 of the first layer. It will be recognized that the hooks of belts 106 and 108 must be of sufficient height to engage and retain at least two layers of fibers.

As the two layers of parallel fibers are advanced into the stitching machine 100, they are stitched together in a vertical direction. Generally, the number of needles used in this stitching will be determined by the requirements of the fabric application, however, this figure can range from one needle per every two inches up to about eighteen needles per inch. A preferred range is 2–12 needles per inch.

In conventional knitting machines, these needles will penetrate the fabric in a vertical direction a number of times per inch of length. Generally, each needle will penetrate about 4–12 times per inch.

Figure 4:
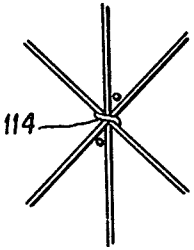
FIG. 4 is a close-up of the stitching employed in this invention.

As illustrated in FIG. 4, this stitching 114 binds all layers together in the vertical direction. Also as illustrated each stitch binds a plurality of fibers together in each layer, maintaining this parallel alignment.

Figure 5:
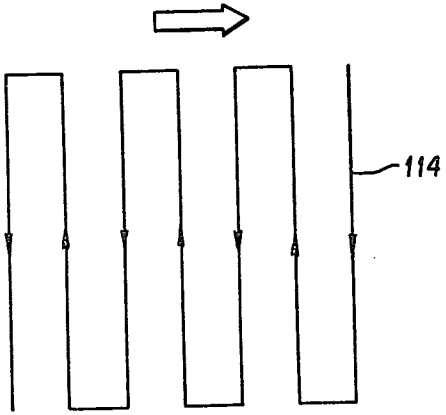
FIGS. 5 and 6 are isolated representatives of the patterns of vertical stitching that may be practiced with this invention.
Figure 6:
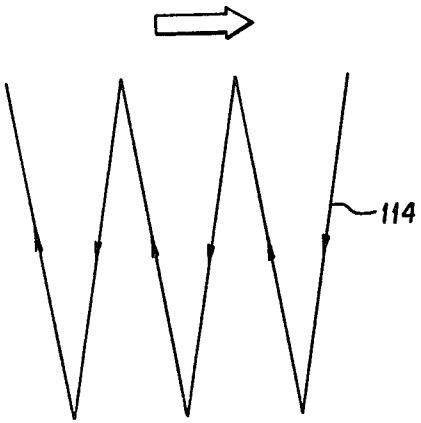

The stitched-together unitary fabric exiting stitching machine 100 may now be stored on a take-up roll (not illustrated) or cut to convenient lengths, etc. It will be recognized that this fabric is comprised of a first layer of parallel fibers, and a second layer of parallel fibers thereon, wherein the fibers of the second layer are aligned at an acute angle to the fibers of the first layer. Although it may be possible to form two-layer fabrics of this type through other, more difficult methods, it is believed that the method of this invention has never been so employed. Certainly, the three or more layer fabrics of this invention are not known, and are the unique product of this process. These fibers, and the fabric itself, are held together by vertical stitching 114. As illustrated in FIG. 5, this vertical stitch pattern may be achieved by stitching across the length of the fabric, advancing the fabric slightly and then stitching back across to the original starting point. (For the sake of clarity the fibers of the fabric have been omitted in FIGS. 5 and 6; to clearly show the pattern formed by stitching). Alternatively, stitching may be constant while the fabric is advanced, in which case a zigzag pattern of stitching will occur as illustrated in FIG. 6. Of course, myriad other stitch patterns will occur to those of skill in the art and are suitable for use in this invention.

The fibers 110 of the first layer and 112 of the second layer may be of any material sufficient to meet the end use of the fabric. Among preferred fibers are those formed from glass, Kevlar®, graphite, carbon, polyester and nylon. The fibers of one layer may be the same as or different from the fibers of another layer. Each layer may incorporate more than one type of fiber, depending on end application.

As the threads used for vertical stitching 114, most natural and virtually all manmade fibers may be used. Among preferred species there are glass, kevlar, graphite, polyester and nylon. A particularly preferred embodiment, of exceedingly high strength, is a multi-layer fabric wherein the fibers of each layer are comprised of graphite, and the vertical stitching is similarly comprised of graphite threads.

Figure 2:
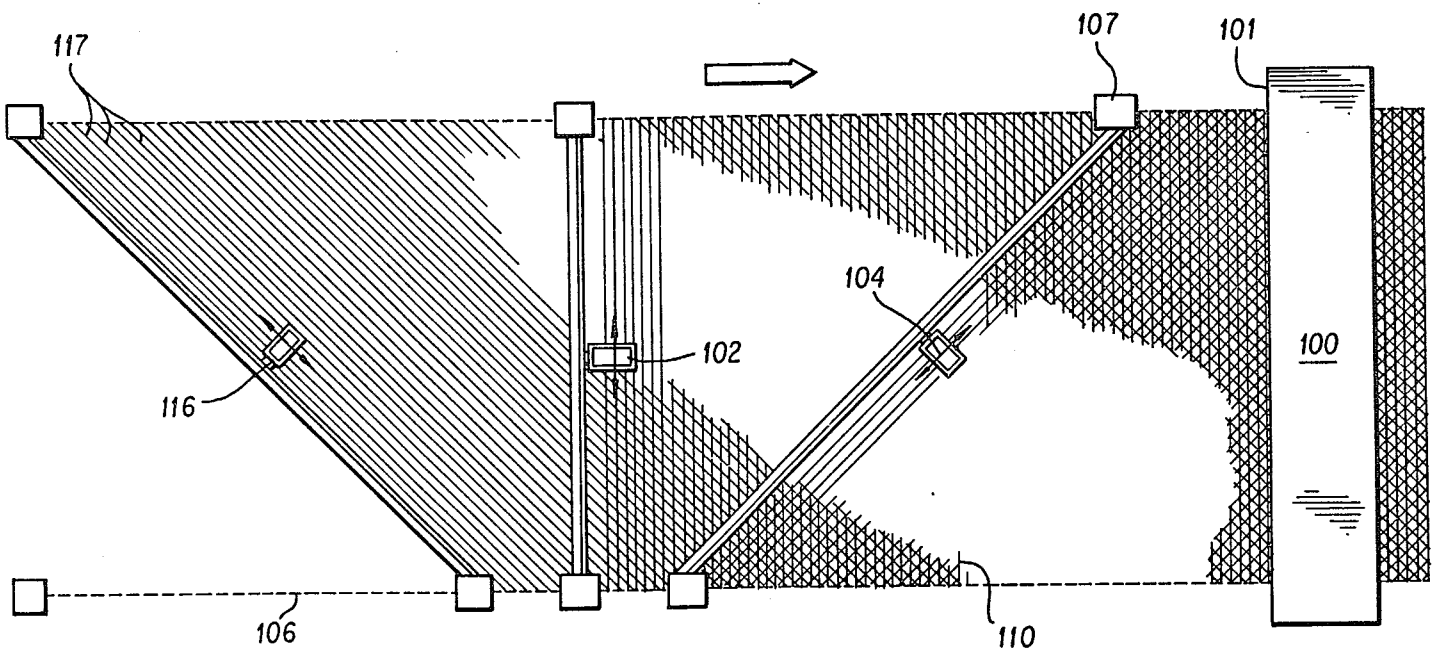

An alternative preferred embodiment of the apparatus of FIG. 1 is illustrated in FIG. 2, wherein an additional lay down carriage 116 has been provided beyond carriage 102, having an orientation opposite from that of carriage 104 for providing a third layer of fibers 117, such that a three-layer fabric, comprised of two biased layers sandwiching a center, unbiased layer may be formed. The operation of the apparatus of FIG. 2 is identical to that of FIG. 1, and similar materials may be employed. It will be recognized that the number of lay-down carriages employed, and the number of layers of fibers provided, will be limited only by the space available for the apparatus, the length of the means for advancing the fibers into the stitching machine and the capacity of the stitching machine to "stitch through" in a vertical direction, the increasing number of layers. Of these three limiting factors, the only one not easily overcome is the capability of the stitching machine to stitch through only so many layers. Frequently, composites of up to 54 layers, wherein the top and bottom 27 layers are mirror images, are necessary. Accordingly, the stitching machine should have the necessary stitch through capacity.

Figure 3:
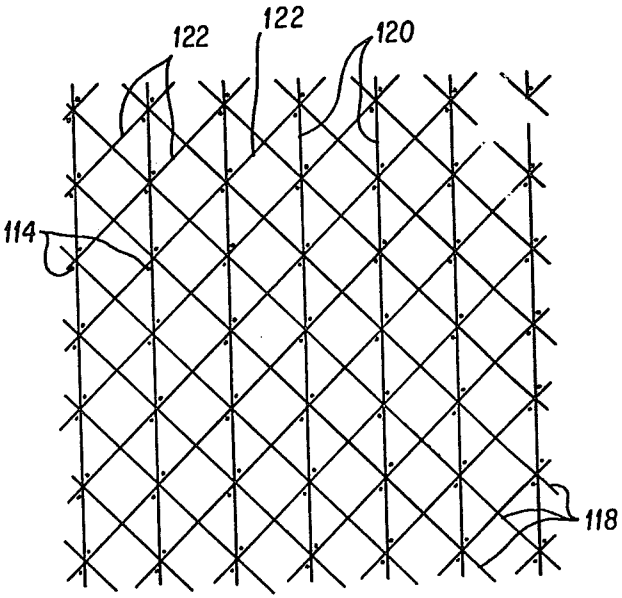
FIG. 3 is an exploded view of the fabric of this invention.

A typical fabric produced by the apparatus of FIG. 2 is illustrated in FIG. 3. This fabric consists of a first layer of biased fibers 118. These are the fibers laid down by carriage 104.

Directly underneath those fibers is a layer of parallel, unbiased fibers 120, which is comprised of the fibers laid down by carriage 102.

Underneath the layer of parallel fibers 120 is a third layer of parallel, biased fibers 122, which are biased at an angle which is the negative of the bias angle of fibers 118.

Of course, the angle of bias of fibers 118 and 122 can be any angle, and is determined by the angle of orientation of their respective lay down carriages. However, in a particularly preferred embodiment, the angle of orientation of one of the outer sides is +45°, the angle of orientation of the remaining outer side is −45°. An alternative preferred embodiment, particularly for tubular elements is one wherein the outer layers are biased at plus and minus one angle of 55°–60°. However, additional applications will occur to those with skill in the requiring different orientations. Moreover, it must be stressed that, particularly in fabrics of three or more layers, randomly selected adjacent layers need not be mirror images of each other, or even mirror images across a central, unbiased layer. In general, angles which are whole number multiples at 15° are preferred.

These layers are bound together in a fabric that may be transported to the desired molding spot, stored, or otherwise handled without destroying the layers and the orientation by virtue of vertical stitching 114. As noted above, the pattern of the stitching formed will depend on the nature of the operation of stitching machine 100, and as is illustrated, in FIG. 3, a "ratchet" type of stitching wherein the machine stitches across the length of the fabric, advances the fabric and stitches back may be employed.

An alternative embodiment of a fabric that may be made with the apparatus of FIG. 2 that has particularly valuable torsional resistance characteristics is one wherein the center, unbiased layer is comprised of fibers having approximately twice the weight of the fibers in the exterior layers. The biased, exterior layers are again orientated at angles of + and −45°.

It is to be critically observed that both the vertical relationship of the layers, and the parallality of the fibers within each layer is maintained solely by threads stitched in the vertical direction. There are no secondary or holding threads in the horizontal direction other than the structural fibers provided by the lay down carriages. In this respect, the fabric of this invention 4 is importantly different from the fabric addressed in U.S. patent application Ser. No. 279,649 filed July 2, 1981. This elimination of the horizontal threads, which add little or no strength to the fabric can save as much as 2 to 3 or even 5–7% of the overall weight of the fabric. A savings of this type, as applied to, e.g., airplanes, represents substantial fuel economy.

Upon completion of the stitched fabric, it may be transported to the molding location, wherein the fabric is saturated with a conventional resin. Although the fabric of this invention is compatible with most resins, and compatability will be further determined by the nature of the fiber employed, exemplary resins that may be used include epoxy resins, vinyl ester resins and polyester resins. The fabric is saturated with the resin which is subsequently cured. Upon curing, a strong, extremely lightweight composite is formed. The strength of the composite is due principally to the parallel structural fibers present in the layers of that composite, and its vertical stitching. Where fibers such as glass are employed, the resin may constitute 45–70% of the composite, on a weight basis. Where graphite is employed, this figure may be 25–50%.

Articles of proprietary interest comprised of multiple layers of parallel structural fibers, wherein the fibers of some of the layers are oriented at a bias, the layers being held together by vertical stitching, the entire fabric being saturated with a resin which is subsequently cured, have been subjected to stress testing. In this testing, a flaw is deliberately introduced into the sample tested, and stress is thereafter applied. In repeated tests, the multi-layer bias composites of this invention demonstrated excellent resistance to the crack propagation phenomena described above, i.e., resistance to the spreading of cracks between layers, in the resin, or layer separation. In fact, the performance of these articles has been superior to conventional metal articles, such as those fabricated from aluminum. The tests have established, simultaneously, that the composites of this invention exhibit excellent shear strength and shearing force resistance, such that the multi-layer aspect of the article does not present a liability as compared with conventional single layer articles constructed of metals and similar materials.

Although the invention has been disclosed, above, with regard to particular and preferred embodiments, these are advanced for illustrative purposes only, and are not intended to limit the scope of this invention. Specifically stitch distances, stitching amounts, fiber and thread materials and angles of orientation have been identified. variations on these and other parameters will occur to those of ordinary skill in the art, without the exercise of inventive faculty. These variations remain within the invention as claimed below.

What is claimed as new and desired to be secured by Letters Patent of the United States is:

1. A method for making a multi-layer non-woven structural fabric, comprising:

advancing at least two layers of substantially parallel structural fibers into a stitching machine, each said layer being free of any secondary yarns in the plane of the layer for maintaining said parallelity, at least one of said layers being biased at an acute angle of 15, 30, 45 or 60°, wherein all said structural fibers of each layer are oriented at substantially the same angle; and stitching said layers together by passing a stitching fiber therethrough in a direction normal thereto, said stitching being sufficient to maintain said vertical relationship of said layers and parallelity of fibers within each layer, wherein each of said layers if formed by a weft lay down carriage aligned with said stitching machine and said other weft lay down carriages, said weft lay down carriage forming said at least one biased layer being oriented at said angle of 15, 30, 45 or 60° with respect to said stitching machine.

2. The method of claim 1, further comprising directing a third such layer into said stitching machine.

3. The method of claim 1, wherein said layers are advanced by a pair of endless rows of hooks passing in engageable contact along either end of said weft carriage machines, advancing said fibers into said stitching machine.

4. The method of claim 1, wherein said structural fibers and said vertical stitching are comprised of graphite fibers.

5. A method for making a multi-layer non-woven structural fabric, comprising:

advancing at least two layers of substantially parallel structural fibers into a stitching machine, each said layer being free of any secondary yarns in the plane of the layer for maintaining said parallelity, at least one of said layers being biased at an angle of 55°–60°, wherein all said structural fibers of each layer of said fabric are oriented at substantially the same angle of bias;

stitching said layers together by passing a stitching fiber therethrough in a direction normal thereto, said stitching being sufficient to maintain said vertical relationship of said layers and parallelity of fibers within each layer;

wherein each of said layers is formed by a weft lay down carriage aligned with said stitching machine and said other weft lay down carriages, said weft lay down carriage forming said at least one biased layer being oriented at said angle of 55°–60° with respect to said stitching machine.

* * * * *

REEXAMINATION CERTIFICATE (693rd)

United States Patent [19]

Hutson

[11] B1 4,484,459

[45] Certificate Issued Jun. 2, 1987

[54] BIASED MULTI-LAYER STRUCTURAL FABRIC COMPOSITES STITCHED IN A VERTICAL DIRECTION AND PROCESS AND APPARATUS FOR MAKING SAME

[75] Inventor: Harold K. Hutson, Seguin, Tex.

[73] Assignee: Knytex Proform, Seguin, Tex.

Reexamination Request:
No. 90/001,058, Jul. 22, 1986

Reexamination Certificate for:

| | |
|---|---|
| Patent No.: | **4,484,459** |
| Issued: | **Nov. 27, 1984** |
| Appl. No.: | **536,734** |
| Filed: | **Sep. 28, 1983** |

[51] Int. Cl.[4] ..... D04B 23/06

[52] U.S. Cl. ..... 66/84 A; 28/100; 156/439

[58] Field of Search ..... 66/84 A, 85 A; 28/100; 156/439, 440

[56] References Cited

U.S. PATENT DOCUMENTS

| | | | |
|---|---|---|---|
| 4,325,999 | 4/1982 | Campman et al. . | |
| 4,385,506 | 5/1983 | Mista | 66/84 A |
| 4,442,684 | 4/1984 | Bergmann | 66/84 A |
| 4,463,580 | 8/1984 | Hittel et al. | 66/84 A |

FOREIGN PATENT DOCUMENTS

| | | | |
|---|---|---|---|
| 46-23580 | 7/1971 | Japan | 28/100 |
| 2059468A | of 0000 | United Kingdom . | |

*Primary Examiner*—Ronald Feldbaum

[57] ABSTRACT

Non-woven, multi-layer biased structural fabric is disclosed, which is comprised of at least three layers of parallel structural fibers, with no secondary yarns or fibers in the plane of the layers to hold said fibers in parallel relationship. Both the vertical relationship of the layers and the parallelity of the fibers within each layer is maintained by vertical stitching. The fabric may be made into a structural composite by saturation and subsequent curing with a curable, crosslinking resin. An apparatus and method for forming that fabric and composite is also disclosed, which is comprised of aligned weft lay down carriages arranged sequentially and further aligned with a stitching machine. A means for advancing the fibers from each weft lay down carriage into the stitching machine passes along the weft carriages. As each layer is laid down on top of the previous layer, it is engaged by the advancing means and so brought into the stitching machine, where the layers are vertically stitched through. At least one of the weft carriages is oriented with respect to the stitching machine, so that the fibers laid down thereby comprise a biased layer.

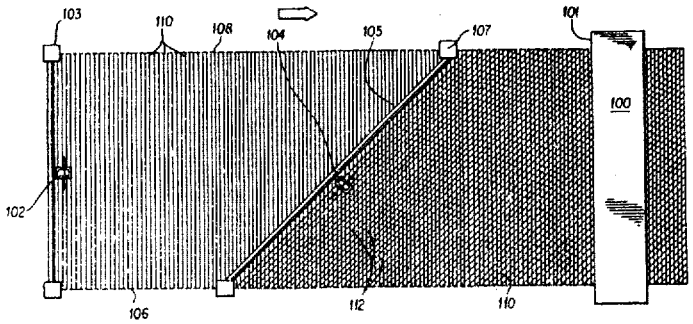

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3 and 5 are determined to be patentable as amended.

Claims 2 and 4, dependent on an amended claim are determined to be patentable.

1. A method for making a multi-layer non-woven structural fabric, comprising:

*continuously* advancing at least two layers of substantially parallel structural fibers into a stitching-machine, each said layer being free of any secondary yarns in the plane of the layer for maintaining said parallelity, at least [one] *a first* of said layers being biased at an acute angle of 15, 30, 45 or 60°, *the bias of the remaining layers being determined independently of the first,* wherein all said structural fibers of each layer are oriented at substantially the same angle; and stitching said layers together by passing a stitching fiber therethrough in a direction normal thereto, said stitching being sufficient to maintain said vertical relationship of said layers and parallelity of fibers within each layer, *whereby a structural fabric is formed* wherein each of said layers [if] *is* formed by a weft lay down carriage aligned with said stitching machine and said other weft lay down carriages, said weft lay down carriage forming said at least [one] *first* biased layer being oriented at said angle of 15, 30, 45 or 60° with respect to said stitching machine, *the bias of said other carriages being determined independently of that of the carriage forming said first layer.*

3. The method of claim 1, wherein said layers are advanced by a pair of endless row of hooks *continuously* passing in engageable contact along either end of said weft carriage machine, *continuously* advancing said fibers into said stitching machine.

5. A method for making a multi-layer non-woven structural fabric, comprising:

*continuously* advancing at least two layers of substantially parallel structural fibers into a stitching machine, each said layer being free of any secondary yarns in the plane of the layer for maintaining said parallelity, at least [one] *a first* of said layers being biased at an angle of 55°-60°, *the bias of the remaining layers being determined independently of the first,* wherein all said structural fibers of each layer are oriented at substantially the same angle of bias;

stitching said layers together by passing a stitching fiber therethrough in a direction normal thereto, said stitching being sufficient to maintain said vertical relationship of said layers and parallelity of fibers within each layer, *whereby a structural fabric is formed* wherein each of said layers is formed by a weft lay down carriage aligned with said stitching machine and said other weft lay down carriages *and is of sufficient density to meet structural loads,* said weft lay down carriage forming said at least [one] *first* biased layer being oriented at said angle of 55°-60° with respect to said stitching machine, *the bias of said other carriages being determined independently of that carriage forming said first layer.*

* * * * *